United States Patent [19]

Meyman

[11] Patent Number: 4,977,913

[45] Date of Patent: Dec. 18, 1990

[54] AUTOMATIC UMBRELLA

[76] Inventor: Usher Meyman, 230 Ocean Pkwy., #E3, Brooklyn, N.Y. 11218

[21] Appl. No.: 339,587

[22] Filed: Apr. 17, 1989

[51] Int. Cl.[5] ..... A45B 25/16

[52] U.S. Cl. ..... 135/24; 135/22; 135/23

[58] Field of Search ..... 135/20 M, 22, 23, 24

[56] References Cited

U.S. PATENT DOCUMENTS

| | | | |
|---|---|---|---|
| 1,708,214 | 4/1929 | Burris | 135/75 |
| 1,797,019 | 3/1931 | Polansky | 135/23 |
| 1,838,004 | 11/1931 | Spiro | 135/75 |
| 2,187,372 | 1/1940 | Capaldo | 135/24 |
| 3,856,030 | 12/1974 | Sato | 135/22 |
| 4,523,601 | 6/1985 | Grady et al. | 135/20 M |
| 4,548,222 | 10/1985 | Day | 135/24 |

FOREIGN PATENT DOCUMENTS

| | | | |
|---|---|---|---|
| 233730 | 11/1925 | United Kingdom | 135/75 |

*Primary Examiner*—Michael Safavi

[57] ABSTRACT

An automatic umbrella has a telescopic stick, a frame carrying a canopy and connected to the stick by rings, automatic closing and opening means, a case connected to the lower tube of the stick, and means for twisting the folds of the canopy. Means for twisting the folds may have a thread provided on the middle tube of the stick, and a notch provided on the lower tube of the stick and engaging with the thread.

3 Claims, 2 Drawing Sheets

AUTOMATIC UMBRELLA

BACKGROUND OF THE INVENTION

The present invention relates to an umbrella and, more particularly, to an automatic umbrella.

Umbrellas having means for automatic opening and closing the frame are known in the art and disclosed, for example, in U.S. Pat. Nos. 4,421,133 and 4,548,222. However, they need a separate case and require additional manual operations for twisting the folds of the canopy, fastening and putting the umbrella into the case.

SUMMARY OF THE INVENTION

Accordingly, it is an object of the present invention to provide an umbrella which avoids the disadvantages of the prior art.

In keeping with these objects and with others which will become apparent hereinafter, one feature of the present invention resides, briefly stated, in an automatic umbrella of the aforementioned general type in which a telescopic stick is provided with a case and with means for twisting the folds of the canopy.

The novel features of the invention are defined in the appended claims. The invention itself will be best understood from the following description accompanied by the drawings.

DESCRIPTION OF PREFERRED EMBODIMENTS

Figure 1:
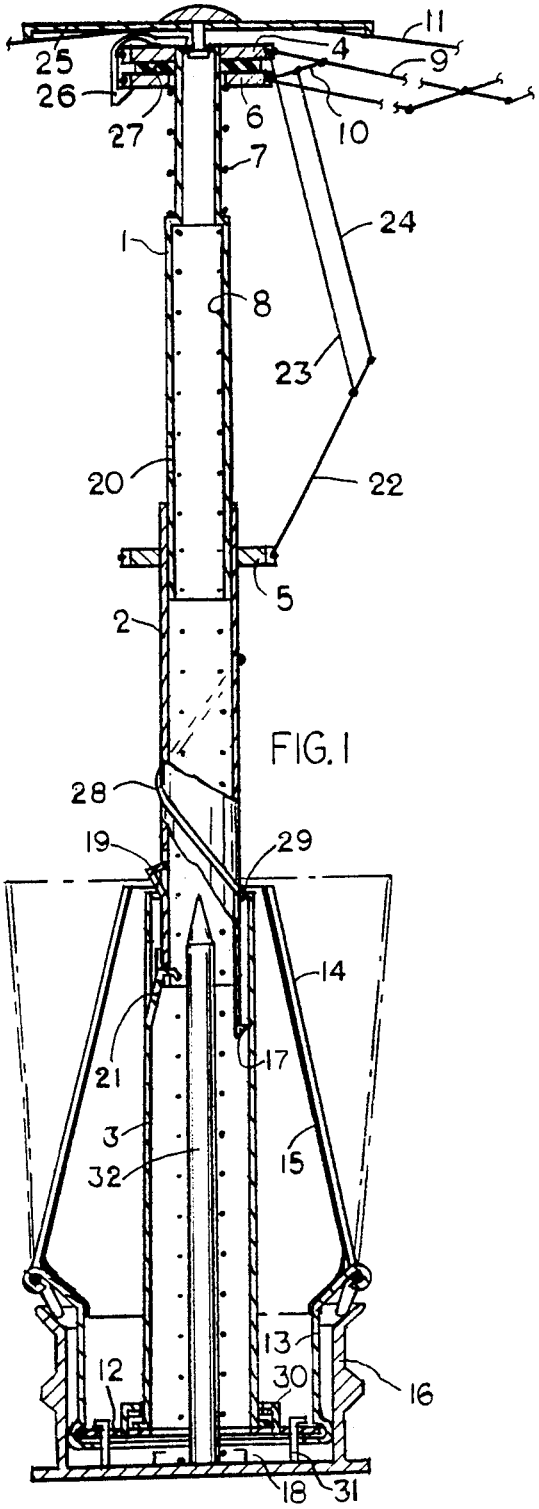
FIG. 1 is a view of an open umbrella in accordance with the present invention.

A telescopic stick of an umbrella in accordance with the present invention comprises tubes 1, 2 and 3 (FIG. 1) slidably disposed within each other. Rings 4 and 5 are fixed accordingly to the upper tube 1 and the middle tube 2. A ring 6 mounted slidably on the tube 1, is spring-loaded by a spring 7. Another spring 8 is disposed within the stick. Main ribs 9 and main stretchers 10 of the frame carrying a canopy 11, are pivotably connected accordingly to the rings 4 and 6. The stick is provided with a case comprising a ring 12 connected with the lower end of the tube 3 by a suitable conventional ratchet and-pawl mechanism 30, a ring 13 connected with the ring 12 with a possibility of rotation relatively to the latter, levers 14 pivotably connected to the ring 13, the elastic fabric 15 attached to the levers 14, and a cup 16 connected with the ring 12 by rods 31 with a possibility of an upward shift relatively to the ring 12. A spring-catch 17 which can be made solid with the tube 2 (or 1), is intended for engaging with one of shoulders 18 provided on the bottom of the cup 16. A spring-catch 19 which can be made solid with the tube 2, is intended for engaging with a cut out 20 in the tube 1. A spring-pawl 21 which can be made solid with the tube 3, prevents premature collapse of the tubes 2 and 3. The cup 16 is provided with a guide 32 for the spring 8.

Means for automatic closing and opening the frame comprises levers 22 (two or more) pivotably connected to the ring 5, pillars 23 pivotably connected to the ring 4, and stretchers 24 pivotably connected to the main stretchers 10 (or to the ring 6, or to the main ribs 9). The pillars 23 and the stretchers 24 are also pivotably connected with the levers 22.

A cap 25 may be connected with the tube 1 with a possibility of rotation and downward shift relatively to the latter. The ring 4 may be provided with a spring-catch 26 engaging the ring 6. A spring or rubber shock-absorber 27 may be placed between the rings 4 and 6.

Means for twisting the folds of the canopy comprises at least one thread 28 provided on the tube 2 and engaging with a notch 29 in the flange of the tube 3.

Figure 3:
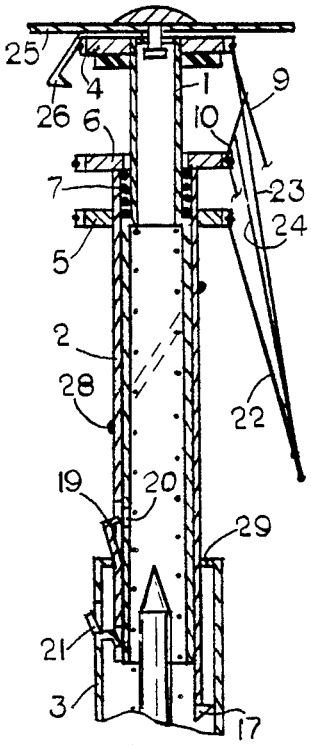
FIGS. 3, 4, 5 and 6 are fragmentary sectional views of the umbrella.

When the cup 16 is pressed by a user towards the cap 25 (or vice versa), it shifts upward relatively to the ring 13 and turns the levers 14 in position shown by dash-dot lines, i.e. opens the case. Simultaneously, the cap 25 shifts downward relatively to the ring 4, deflects the spring-catch 26 to the left and releases the ring 6. Then, the tube 2 carrying the ring 5, slides over the tube 1 towards the ring 4. The ring 5 turns the right lever 22 supported by the pillar 23, clockwise and pulls the stretcher 24 downward Thc stretchers 24 pull the main stretchers 10 and, therefore, the ring 6 downward compressing the spring 7 and closing the frame. At this moment (FIG. 3), the lower end of the tube 1 deflects the spring-pawl 21 to the left, and the tube 3 starts to slide upward over the tube 2 causing the spring-catch 19 to engage with the cut out 20, i.e. to fix the tube 2 with the tube 1. Thanks to the thread 28 engaging with the notch 29, the tubes 2 and 1 with the closed frame rotate around the axis of the tube 3 stopped by the ratchet-and-pawl mechanism 30. Therefore, the folds of the canopy are twisting by the upper edge of the case, and umbrella easily enters into the latter. After the spring-catch 17 engages one of the shoulders 18 (depending on the position of the mechanism 30), the umbrella is fully closed and put into the case.

When the user turns the cup 16 around the tube 3 (in direction permissible by the mechanism 30) by some angle, the shoulder 18 releases the spring-catch 17, the spring 8 compressed by the collapsed stick, starts to push the umbrella out of the case, and the above-stated operations occur in the reverse order. However, the tube 3 rotates instead of the rest parts of the umbrella in permissible by the mechanism 30 direction.

The absence of any operating button averts accidental opening of the umbrella.

Figure 4:
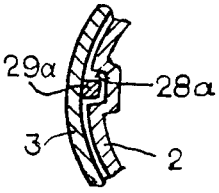

Means for twisting the folds may represent a screw groove **28*a* (FIG. 4) provided on the tube 2, and a projection 29*a* on the tube 3**.

Figure 2:
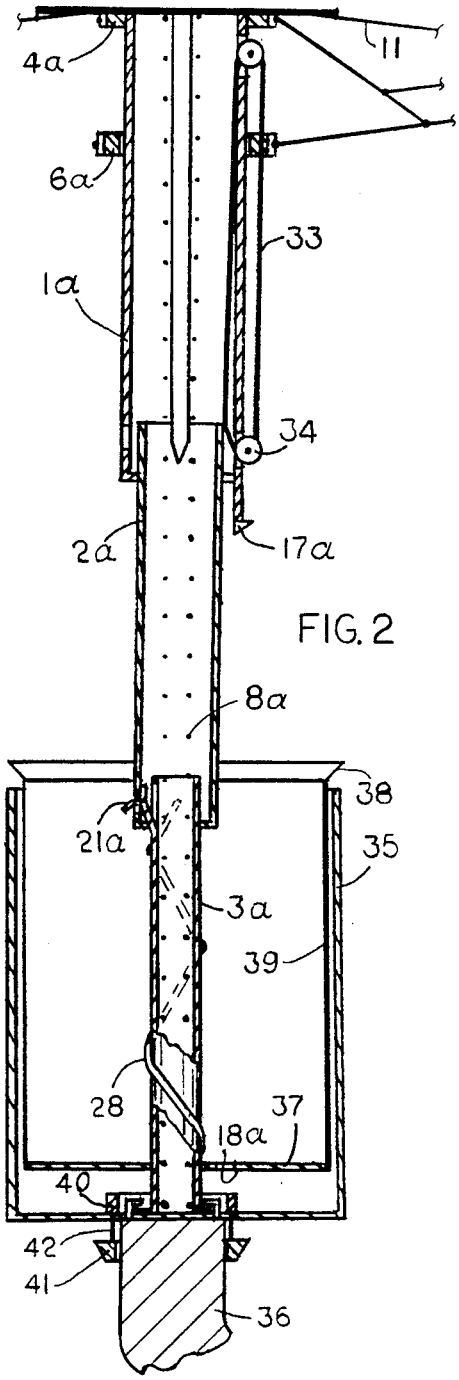
FIG. 2 is a view of another embodiment of the present invention.

Accordingly to another embodiment of the invention (FIG. 2), means for automatic closing and opening the frame has one fixed ring **4*a* and one sliding ring 6*a* which is connected with a tube 2*a* by at least one endless rope 33 roved through pulleys 34, and a spring 8*a* disposed within the stick. A spring-pawl 21*a* prevents premature collapse of the tubes 2*a* and 3*a*. An integral cup 35 is fixed to a handle 36. The tube 3*a* is provided with a rotator having a spider (or disc) 37 and a ring 38 connected with the spider by posts 39. When the tubes 1*a* and 2*a* collapse, the latter pulls the ring 6*a* downward by the rope 33 and closes the frame. When the tubes 2*a* and 3*a* collapse, the rotator rotates with the tube 3*a*, and the ring 38 twists thc folds of the canopy 11. Independently on position of the spider 37 of the closed umbrella, a ring 40 disengages a spring-catch 17*a* from a cut out 18*a* in the spider when the user pushes upward a control ring 41 connected with the ring 40 by rods 42. A rotator may represent a cup serving as a case and eliminating a necessity of the cup 35**.

Figure 5:
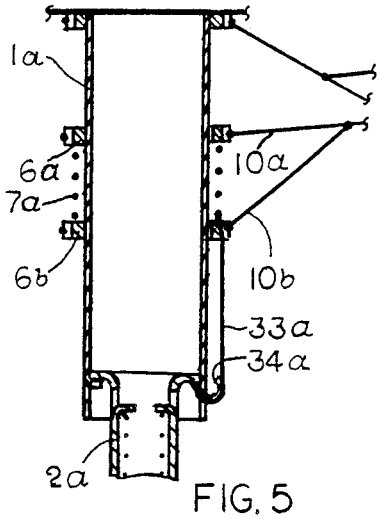

The tube 1*a* (FIG. 5) may be provided with two sliding rings 6*a* and 6*b* with a spring 7*a* therebetween. When the tubes 1*a* and 2*a* collapse, a rope 33*a* roved through a fold 34*a*, pulls the ring 6*b* with pivotably connected auxiliary stretchers 10*b* and, therefore, main stretchers 10*a*, closing the frame and compressing the spring 7*a* by the ring 6*a*.

Figure 6:
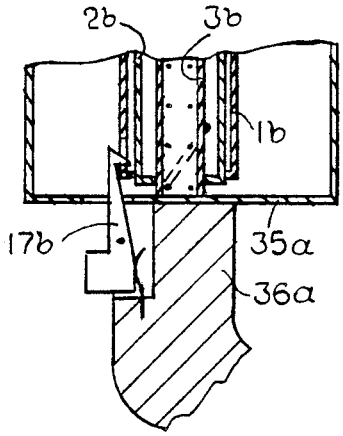

A tube 3*b* (FIG. 6) and a case 35*a* may be fixed to a handle 36*a*. After a conventional spring-catch 17*b* releases the rest parts of the umbrella during upward sliding over a tube 3*b*, as well as during their collapsing.

A stick may comprise more than three tubes. Some of tubes may be non-circular.

The invention is not limited to the details shown since various modifications and structural changes are possible without departing in any way from the spirit of the present invention.

What is desired to be protected by Letters Patent is set forth in the claims.

I claim:

1. An automatic umbrella comprising a telescopic stick comprising an upper tube, at least one middle tube, and a lower tube;

at least two rings, one of said rings is fixed to said upper tube, and other of said rings is slidably mounted on said upper tube;

a canopy;

a frame supporting said canopy and having main ribs pivotably connected to said fixed ring and main stretchers pivotably connected to said sliding ring;

means for automatic closing and opening said frame;

a case for the closed umbrella provided on said lower tube; and means for twisting the folds of the canopy which appear during closing the frame by spirally moving said middle and lower tubes relative to one another.

2. An automatic umbrella as defined in claim 1, wherein said means for twisting said folds comprises a thread provided on said middle tube, and a notch provided on said lower tube and engaging with said thread.

3. An automatic umbrella as defined in claim 1, wherein said means for automatic closing and opening said frame comprises an auxiliary ring fixed to said middle tube, pillars pivotably connected to said fixed ring, stretchers pivotably connected to said main stretchers, levers pivotably connected to said auxiliary ring, said pillars and stretchers are pivotably connected with said levers.

* * * * *